US009968999B2

(12) United States Patent
Singh et al.

(10) Patent No.: US 9,968,999 B2
(45) Date of Patent: May 15, 2018

(54) BORON DOPED MANGANESE ANTIMONIDE AS A USEFUL PERMANENT MAGNET MATERIAL

(71) Applicant: COUNCIL OF SCIENTIFIC & INDUSTRIAL RESEARCH, New Delhi (IN)

(72) Inventors: Nidhi Singh, New Delhi (IN); Jiji Thomas Joseph Pulikkotil, New Delhi (IN); Anurag Gupta, New Delhi (IN); Kanika Anand, New Delhi (IN); Ajay Dhar, New Delhi (IN); Ramesh Chandra Budhani, New Delhi (IN)

(73) Assignee: COUNCIL OF SCIENTIFIC & INDUSTRIAL RESEARCH, New Delhi (IN)

( * ) Notice: Subject to any disclaimer, the term of this patent is extended or adjusted under 35 U.S.C. 154(b) by 475 days.

(21) Appl. No.: 14/516,007

(22) Filed: Oct. 16, 2014

(65) Prior Publication Data

US 2015/0110662 A1 Apr. 23, 2015

(30) Foreign Application Priority Data

Oct. 17, 2013 (IN) ..... 3078/DEL/2013

(51) Int. Cl.

| | |
|---|---|
| ***H01F 41/02*** | (2006.01) |
| ***B22F 3/10*** | (2006.01) |
| ***C22C 12/00*** | (2006.01) |
| ***H01F 1/047*** | (2006.01) |
| ***H01F 1/08*** | (2006.01) |

(52) U.S. Cl.

CPC ..... *B22F 3/10* (2013.01); *C22C 12/00* (2013.01); *H01F 1/047* (2013.01); *H01F 1/08* (2013.01)

(58) Field of Classification Search

CPC ..... C22C 12/00

See application file for complete search history.

(56) References Cited

U.S. PATENT DOCUMENTS 3,226,225 A * 12/1965 Weiss ..... C30B 21/02 117/46

6,855,460 B2 * 2/2005 Vaughey ..... C22C 1/0491 429/218.1

OTHER PUBLICATIONS

Kushwaha et al., Metastability in the ferrimagnetic—antiferromagnetic phase transition in Co substituted Mn2Sb, J. Phys.: Condens. Matter 20 (2008) 022204 (7pp).*

* cited by examiner

*Primary Examiner* — Christopher Kessler

(74) *Attorney, Agent, or Firm* — Blank Rome LLP

(57) ABSTRACT

Permanent magnets are used for several important applications, including dc electrical motors, wind turbines, hybrid automobile, and for many other applications. Modern widely used rare-earth based permanent magnet materials, such as Sm—Co and Nd—Fe—B, are generally intermetallic alloys made from rare earth elements and transition metals such as cobalt. However, the high costs of rare earth elements make the widespread use of these permanent magnets commercially unattractive. The present work focuses on producing a new permanent magnet material, with good magnetic properties, which is free from rare-earth elements and thus cost-effective. The present invention provides a process to synthesis boron doped manganese antimonide as an alternative to rare earth based permanent magnet materials. The boron doped manganese antimonide disclosed in this invention is free from rare-earth element with good magnetic properties. The material in the present study has been synthesized employing sequential combination of high energy ball milling, arc melting under argon atmosphere and again high energy ball milling followed by annealing. The annealed boron doped manganese antimonide shows improved magnetic properties as compared to manganese antimonide.

5 Claims, 2 Drawing Sheets

BORON DOPED MANGANESE ANTIMONIDE AS A USEFUL PERMANENT MAGNET MATERIAL

TECHNICAL FIELD OF THE INVENTION

The present invention relates to Boron doped manganese antimonide as a permanent magnet material which is free from rare-earth elements with good magnetic properties. Particularly, present invention relates to a process for the preparation of Boron doped manganese antimonide as a permanent magnet material. More particularly, present invention relates to to Boron doped manganese antimonide useful as a permanent magnet material for DC electrical motors, hybrid automobile, wind turbines etc.

BACKGROUND AND PRIOR ART OF THE INVENTION

Permanent magnets are used for several important applications, including DC electrical motors, wind turbines, hybrid automobile, and for many other applications. Modern widely used rare-earth based permanent magnet materials, such as Sm—Co and Nd—Fe—B, are generally intermetallic alloys made from rare earth elements and transition metals such as cobalt. They derive their exceptional magnetic properties from the combination of the rare earth elements sub-lattice providing the high magnetic anisotropy and the 3-D sub-lattices of Fe or Co giving a large magnetization and a high Curie temperature. However, the high costs of rare earth elements make the widespread use of these permanent magnets commercially unattractive.

Thus, finding a viable alternative to rare-earth based permanent magnets has become critical to decrease their cost and make them commercially viable for various applications. The present work focuses on producing permanent magnetic material, with good magnetic properties, which is free from rare-earth elements and thus cost-effective.

There are many known permanent magnetic material in the literature synthesized by different research groups.

Reference is made to Zeng et.al. (Journal of Applied Physics 99, (2006) pp. 08E90201-03) wherein the synthesis of τ-MnAl was carried out by arc melting under an argon atmosphere subsequently heating to 1150° C. and holding for 20 h followed by water quenching. Then the quenched material was crushed and milled in argon for 8 h in a hardened steel vial using a SPEX 8000 mill using hardened steels balls with a ball-to-charge weight ratio of 10:1. Samples were annealed at temperatures from 350 to 600° C. for 10 min to produce the ferromagnetic τ-MnAl. The resulting material exhibited magnetic properties, coercive field of 4.8 kOe and saturation magnetization 87 emu/g for powder annealed at 400° C. for 10 min.

Yet another reference is made to Liu et.al. (J Mater Sci vol. 47 (2012) pp. 2333-2338), wherein MnAl alloys with C doping was prepared by argon arc melting. The melted samples were used to prepare ribbon samples by a single-roller melt spinning technique under protective atmosphere (argon) at a wheel speed of 40 m/s. The as spun ribbons were annealed at 500-650° C. for 10 min. in Argon. The effects of composition and heat treatment on the phase transition and hard magnetic properties were investigated. Addition of C was found beneficial to the formation of the τ MnAl. Addition carbon modifies $T_C$ of τ phase. 2% C addition reduced the $T_C$ from 346 to 258° C. The $Mn_{53.3}Al_{45}C_{1.7}$ ribbon after annealing at 650° C. for 10 min exhibited best combined magnetic properties i.e. saturation polarization 0.83 T, remanence 0.30 T, coercivity 123 kA/m, and maximum energy product 12.24 kJ/m$^3$.

Yet another reference is made to Rao et.al. (J. Phys. D: Appl. Phys. Vol. 46 (2013) pp. 062001-04), wherein MnBi ingot was prepared by argon arc-melting. The ingot was annealed at 573K for 24 h in vacuum to obtain the LTP MnBi. The annealed alloy ingots were manually crushed and Low Energy Ball Milled for different milling times up to 8 h in a hardened stainless steel vial using rotary mill with rotation speed of 150 rpm. The milling was performed in hexane with hardened-steel balls 4-12 mm in diameter. The ball-to-powder weight ratio was about 15:1. The milled powders were compacted at room temperature in the presence of a 1.8 T magnetic field. The green compacts were then placed into a tungsten carbide die and subjected to hot compaction at 593K for 10 min with an applied pressure of 300 MPa under vacuum (better than $4\times10^{-5}$ mbar.). Maximum energy product of 5.8 MGOe at room temperature and 3.6 MGOe at 530K has been obtained in synthesized MnBi.

Yet another reference is made to Journal of Applied Physics vol. 112, (2012) pp. 083901-04, wherein $Mn_{100-x}Ga_x$ (x=20-50) alloy ingots were prepared by argon arc melting. The melted samples were used to prepare ribbon. As spun ribbons were heat treated in an argon atmosphere at temperatures between 573K and 1073K for 1 h. A maximum coercivity value of 5.7 kOe was achieved in the $Mn_{70}Ga_{30}$ melt-spun ribbon annealed at 973K for 1 h.

The present invention describes the synthesis of a new permanent magnet material, boron doped manganese antimonide which is free from rare-earth elements with good magnetic properties.

OBJECTIVE OF THE INVENTION

The main object of the present invention is to provide boron doped manganese antimonide as a permanent magnet material with good magnetic properties.

Another object of the present invention is to provide a permanent magnet material, which does not have rare earth elements as its continent elements.

Yet another object of the present invention is to provide a process for the synthesis of boron doped manganese antimonide as a potential permanent magnetic material.

SUMMARY OF THE INVENTION

Accordingly, present invention provides boron doped manganese antimonide as a permanent magnet material comprising 46.5-47 wt. % of Manganese (Mn), 51.5-52 wt. % of antimony (Sb) and Boron (B) doping in the range 1.0-1.8 wt. %.

In an embodiment, present invention provides a process for the preparation of Boron doped manganese antimonide comprising the steps of:

i. mixing Mn powder, Sb powder and B powder in the ratio ranging between 46.5:51.7:1.8 to 47.0:52.0:1.0 and then milling in high energy planetary ball mill with 2 to 4 wt. % of process control agent in an inert atmosphere of argon gas to obtain homogeneously blended powders of Mn, Sb and B;

ii. compacting blended powders of Mn, Sb and B as obtained in step (i) at a pressure of 0.1 to 0.5 MPa to obtain compacted pellets;

iii. arc melting the compacted pellets as obtained in step (ii) in 2 psi argon atmosphere to obtain melted pellets of B doped $Mn_2Sb$;

iv. crushing melted pellets of B doped $Mn_2Sb$ as obtained in step (iii) in mortar and pestle and again ball milled in high energy planetary ball mill with 2 to 3 wt. % stearic acid as a process control agent in an inert atmosphere of argon gas to obtain boron doped $Mn_2Sb$ powder;

v. compacting boron doped $Mn_2Sb$ powders using a high strength stainless steel die and punch on a hydraulic press at a pressure of 0.1 to 0.5 MPa to form a pellet;

vi. annealing the pellets at temperature in the range of 240 to 270° C. for period in the range of 5 to 7 hours to obtain Boron doped manganese antimonide.

In another embodiment of the present invention, high energy ball milling in step (i) is carried out at a speed of 300 to 400 rpm with a ball to powder ratio of 15:1 to 20:1 for 2 to 7 hours in a hardened stainless steel grinding jars with hardened stainless steel grinding balls.

In yet another embodiment of the present invention, process control agent used is stearic acid.

In another embodiment of the present invention high energy ball milling in step (iv) is carried out at a speed of 300 to 400 rpm with a ball to powder ratio of 15:1 to 20:1 for period in the range of 2 to 3 hours in a hardened stainless steel grinding jars with hardened stainless steel grinding balls.

DETAILED DESCRIPTION OF THE INVENTION

Modern widely used rare-earth based permanent magnet materials, such as Sm—Co and Nd—Fe—B, are generally intermetallic alloys containing rare earth elements, such as Nd, Sm, Dy, etc. However, the high costs of rare earth elements make the widespread use of these permanent magnets commercially unattractive. The present work focuses on producing a new permanent magnet material, boron doped manganese antimonide, with good magnetic properties, which is free from rare-earth elements and thus cost-effective. The present invention provides a process to synthesis as an alternative to rare earth based permanent magnet materials. The material in the present study has been synthesized employing sequential combination of high energy ball milling, arc melting under argon atmosphere and again high energy ball milling followed by annealing. The annealed boron doped manganese antimonide shows improved magnetic properties as compared to manganese antimonide.

A new permanent magnet material boron doped Manganese antimonide material ($(Mn_2Sb)_{1-x}B_x$) which was synthesized wherein the composition comprises of 46.5-47 wt. % of Manganese (Mn), 51.5-52 wt. % of antimony (Sb) and Boron (B) doping in the range 1.0-1.8 wt. % and adjusting the Mn, Sb and B ratio in the given range so that the total percentage of end product should not be more/less than 100%. These powders were mixed and multi step processed employing high energy ball milling, arc melting, followed by high energy ball milling and finally annealing in inert (argon) atmosphere.

Figure 1:
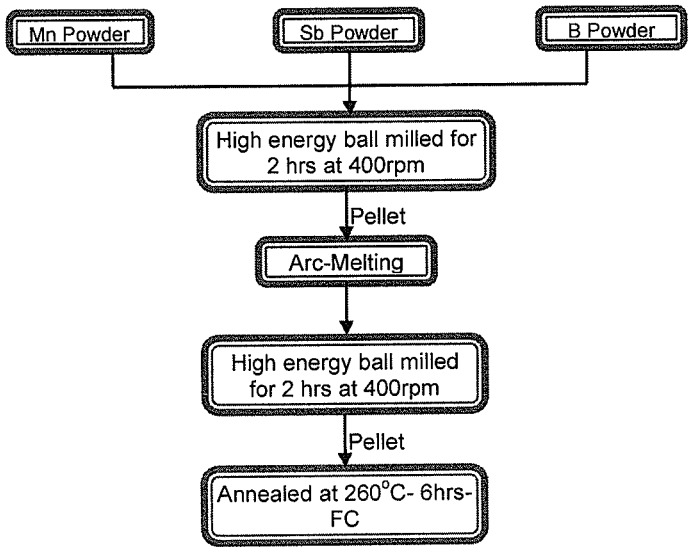
FIG. 1: Schematic representation of experimental steps employed in the synthesis of boron doped manganese antimonide

The schematic diagram of the experimental steps employed in the synthesis of boron doped manganese antimonide is shown in FIG. 1. 4.67 gm of Mn powder (99.5% purity), 5.17 gm of Sb powder (99.5% purity) and 0.16 gm of B powder (99.5% purity) were mixed in mortar and pestle and then milled in high energy planetary ball mill with 3 wt. % stearic acid as a process control agent in 80 ml grinding jars made of hardened stainless steel and using 5 mm diameter grinding balls also made of hardened stainless steel with ball to powder ratio of 15:1 for 2 hours at a speed of 400 rpm, in an inert atmosphere of argon gas, resulting in homogeneously blended powders of Mn, Sb and B.

These ball milled Mn, Sb and B powders were handled in glove box under high purity argon to avoid any oxidation and atmospheric contamination. These high energy ball milled powders of Mn, Sb and B powders were compacted using a high strength stainless steel die and punch on a hydraulic press to form a pellet of 3 mm thickness and 10 mm diameter, at a pressure of 0.1 to 0.5 MPa.

Figure 2:
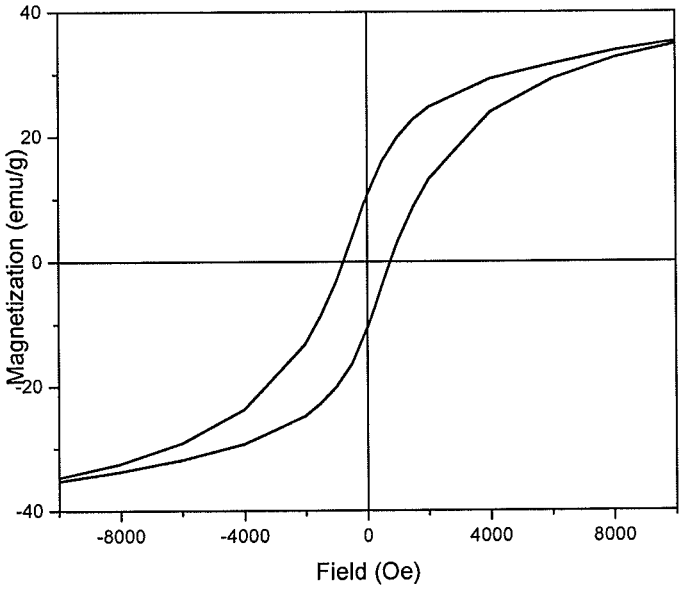
FIG. 2: Hysteresis Response of Boron doped $Mn_2Sb$-System synthesized employing High energy ball milling, Arc Melting followed by high energy ball milling and annealing.

These compacted pellets were arc melted in 2 psi argon atmosphere and the resulting melted pellets of B doped $Mn_2Sb$ were crushed in mortar and pestle and again ball milled in high energy planetary ball mill with 3 wt. % stearic acid as a process control agent in 80 ml grinding jars made of hardened stainless steel and using 5 mm diameter grinding balls also made of hardened stainless steel with ball to powder ratio of 15:1 for 2 hours at a speed of 400 rpm, in an inert atmosphere of argon gas to obtain boron doped $Mn_2Sb$ powder. These boron doped Mn2Sb powders were compacted using a high strength stainless steel die and punch on a hydraulic press at a pressure of 0.1 to 0.5 MPa to form a pellet of 3 mm thickness and 10 mm diameter. These pellets were subjected to annealing treatment at temperature of 260° C. for 6 hours. The magnetic property of the annealed Boron doped $Mn_2Sb$ is shown in FIG. 2.

EXAMPLES

The following examples are given by way of illustration therefore should not be construed to limit the scope of the invention.

Example 1

4.67 gm of Mn powder (99.5% purity), 5.17 gm of Sb powder (99.5% purity) and 0.16 gm of B powder (99.5% purity) were mixed in mortar and pestle and then milled in high energy planetary ball mill with 3 wt. % stearic acid as a process control agent in 80 ml grinding jars made of hardened stainless steel and using 5 mm diameter grinding balls also made of hardened stainless steel with ball to powder ratio of 15:1 for 2 hours at a speed of 400 rpm, in an inert atmosphere of argon gas, resulting in homogeneously blended powders of Mn, Sb and B.

These ball milled Mn, Sb and B powders were handled in glove box under high purity argon to avoid any oxidation and atmospheric contamination. These high energy ball milled powders of Mn, Sb and B powders were compacted using a high strength stainless steel die and punch on a hydraulic press to form a pellet of 3 mm thickness and 10 mm diameter, at a pressure of 0.1 to 0.5 MPa.

These compacted pellets were arc melted in 2 psi argon atmosphere and the resulting melted pellets of B doped $Mn_2Sb$ were crushed in mortar and pestle and again ball milled in high energy planetary ball mill with 3 wt. % stearic acid as a process control agent in 80 ml grinding jars made of hardened stainless steel and using 5 mm diameter grinding balls also made of hardened stainless steel with ball to powder ratio of 15:1 for 2 hours at a speed of 400 rpm, in an inert atmosphere of argon gas to obtain boron doped $Mn_2Sb$ powder. These boron doped $Mn_2Sb$ powders were compacted using a high strength stainless steel die and punch on a hydraulic press at a pressure of 0.1 to 0.5 MPa to form a pellet of 3 mm thickness and 10 mm diameter. These pellets were subjected to annealing treatment at temperature of 260° C. for 6 hours.

Example 2

14.01 gm of Mn powder (99.5% purity), 15.51 gm of Sb powder (99.5% purity) and 0.48 gm of B powder (99.5% purity) were mixed in mortar and pestle and then milled in high energy planetary ball mill with 3 wt. % stearic acid as a process control agent in 250 ml grinding jars made of hardened stainless steel and using 10 mm diameter grinding balls also made of hardened stainless steel with ball to powder ratio of 15:1 for 2 hours at a speed of 400 rpm, in an inert atmosphere of argon gas, resulting in homogeneously blended powders of Mn, Sb and B.

These ball milled Mn, Sb and B powders were handled in glove box under high purity argon to avoid any oxidation and atmospheric contamination. These high energy ball milled powders of Mn, Sb and B powders were compacted using a high strength stainless steel die and punch on a hydraulic press to form a pellet of 3 mm thickness and 10 mm diameter, at a pressure of 0.1 to 0.5 MPa.

These compacted pellets were arc melted in 2 psi argon atmosphere and the resulting melted pellets of B doped $Mn_2Sb$ were crushed in mortar and pestle and again ball milled in high energy planetary ball mill with 3 wt. % stearic acid as a process control agent in 250 ml grinding jars made of hardened stainless steel and using 10 mm diameter grinding balls also made of hardened stainless steel with ball to powder ratio of 15:1 for 2 hours at a speed of 400 rpm, in an inert atmosphere of argon gas to obtain boron doped $Mn_2Sb$ powder. These boron doped $Mn_2Sb$ powders were compacted using a high strength stainless steel die and punch on a hydraulic press at a pressure of 0.1 to 0.5 MPa to form a pellet of 3 mm thickness and 10 mm diameter. These pellets were subjected to annealing treatment at temperature of 260° C. for 6 hours.

Example 3

4.67 gm of Mn powder (99.5% purity), 5.17 gm of Sb powder (99.5% purity) and 0.16 gm of B powder (99.5% purity) were mixed in mortar and pestle and then milled in high energy planetary ball mill with 3 wt. % stearic acid as a process control agent in 80 ml grinding jars made of hardened stainless steel and using 5 mm diameter grinding balls also made of hardened stainless steel with ball to powder ratio of 15:1 for 2 hours at a speed of 400 rpm, in an inert atmosphere of argon gas, resulting in homogeneously blended powders of Mn, Sb and B.

These ball milled Mn, Sb and B powders were handled in glove box under high purity argon to avoid any oxidation and atmospheric contamination. These high energy ball milled powders of Mn, Sb and B powders were compacted using a high strength stainless steel die and punch on a hydraulic press to form a pellet of 3 mm thickness and 10 mm diameter, at a pressure of 0.1 to 0.5 MPa.

These compacted pellets were arc melted in 2 psi argon atmosphere and the resulting melted pellets of B doped $Mn_2Sb$ were crushed in mortar and pestle and again ball milled in high energy planetary ball mill with 3 wt. % stearic acid as a process control agent in 80 ml grinding jars made of hardened stainless steel and using 5 mm diameter grinding balls also made of hardened stainless steel with ball to powder ratio of 15:1 for 2 hours at a speed of 400 rpm, in an inert atmosphere of argon gas to obtain boron doped $Mn_2Sb$ powder. These boron doped $Mn_2Sb$ powders were compacted using a high strength stainless steel die and punch on a hydraulic press at a pressure of 0.1 to 0.5 MPa to form a pellet of 3 mm thickness and 10 mm diameter. These pellets were subjected to annealing treatment at temperature of 270° C. for 4 hours.

Example 4

14.01 gm of Mn powder (99.5% purity), 15.51 gm of Sb powder (99.5% purity) and 0.48 gm of B powder (99.5% purity) were mixed in mortar and pestle and then milled in high energy planetary ball mill with 3 wt. % stearic acid as a process control agent in 250 ml grinding jars made of hardened stainless steel and using 10 mm diameter grinding balls also made of hardened stainless steel with ball to powder ratio of 15:1 for 2 hours at a speed of 400 rpm, in an inert atmosphere of argon gas, resulting in homogeneously blended powders of Mn, Sb and B.

These ball milled Mn, Sb and B powders were handled in glove box under high purity argon to avoid any oxidation and atmospheric contamination. These high energy ball milled powders of Mn, Sb and B powders were compacted using a high strength stainless steel die and punch on a hydraulic press to form a pellet of 3 mm thickness and 10 mm diameter, at a pressure of 0.1 to 0.5 MPa.

These compacted pellets were arc melted in 2 psi argon atmosphere and the resulting melted pellets of B doped $Mn_2Sb$ were crushed in mortar and pestle and again ball milled in high energy planetary ball mill with 3 wt. % stearic acid as a process control agent in 250 ml grinding jars made of hardened stainless steel and using 10 mm diameter grinding balls also made of hardened stainless steel with ball to powder ratio of 15:1 for 2 hours at a speed of 400 rpm, in an inert atmosphere of argon gas to obtain boron doped $Mn_2Sb$ powder. These boron doped $Mn_2Sb$ powders were compacted using a high strength stainless steel die and punch on a hydraulic press at a pressure of 0.1 to 0.5 MPa to form a pellet of 3 mm thickness and 10 mm diameter. These pellets were subjected to annealing treatment at temperature of 270° C. for 4 hours.

Advantages of the Invention

Permanent magnets are used for several important applications, including dc electrical motors, wind turbines, hybrid automobile, and for many other applications. Modern widely used rare-earth based permanent magnet materials, such as Sm—Co and Nd—Fe—B, are generally intermetallic alloys made from rare earth elements and transition metals such as cobalt. However, the high costs of rare earth elements make the widespread use of these permanent magnets commercially unattractive.

Thus, finding a viable alternative to rare-earth based permanent magnets has become critical to decrease their cost and make them commercially viable for various applications.

We claim:

1. Boron doped manganese antimonide as a permanent magnet material comprising 46.5-47 wt. % of Manganese (Mn), 51.5-52 wt. % of antimony (Sb) and Boron (B) doping in the range 1.0-1.8 wt. %.

2. A process for the preparation of Boron doped manganese antimonide comprising the steps of:

i. mixing Mn powder, Sb powder and B powder in the ratio ranging between 46.5:51.7:1.8 to 47.0:52.0:1.0 and then milling in high energy planetary ball mill with 2 to 4 wt. % of process control agent in an inert atmosphere of argon gas to obtain homogeneously blended powders of Mn, Sb and B;

ii. compacting blended powders of Mn, Sb and B as obtained in step (i) at a pressure of 0.1 to 0.5 MPa to obtain compacted pellets;

iii. arc melting the compacted pellets as obtained in step (ii) in 2 psi argon atmosphere to obtain melted pellets of B doped $Mn_2Sb$;

iv. crushing melted pellets of B doped $Mn_2Sb$ as obtained in step (iii) in mortar and pestle and again ball milled in high energy planetary ball mill with 2 to 3 wt. % stearic acid as a process control agent in an inert atmosphere of argon gas to obtain boron doped $Mn_2Sb$ powder;

v. compacting boron doped $Mn_2Sb$ powders using a high strength stainless steel die and punch on a hydraulic press at a pressure of 0.1 to 0.5 MPa to form a pellet;

vi. annealing the pellets at temperature in the range of 240 to 270° C. for period in the range of 5 to 7 hours to obtain Boron doped manganese antimonide.

3. The process as claimed in claim 2, wherein step (i) the high energy ball milling is carried out at a speed of 300 to 400 rpm with a ball to powder ratio of 15:1 to 20:1 for 2 to 7 hours in a hardened stainless steel grinding jar with hardened stainless steel grinding balls.

4. The process as claimed in claim 2, wherein step (i) the process control agent used is stearic acid.

5. The process as claimed in claim 2, wherein step (iv) high energy ball milling is carried out at a speed of 300 to 400 rpm with a ball to powder ratio of 15:1 to 20:1 for period in the range of 2 to 3 hours in a stainless steel grinding jar with stainless steel grinding balls.

* * * * *